US010450945B2

(12) United States Patent
Rohs

(10) Patent No.: US 10,450,945 B2
(45) Date of Patent: Oct. 22, 2019

(54) METHOD FOR OPERATING AN AXIAL PISTON MOTOR, AND AXIAL PISTON MOTOR

(71) Applicant: GETAS Gesellschaft für thermodynamische Antriebssysteme mbH, Dueren (DE)

(72) Inventor: Ulrich Rohs, Dueren (DE)

(73) Assignee: GETAS Gesellschaft für thermodynamische Antriebssysteme mbH, Dueren (DE)

( * ) Notice: Subject to any disclaimer, the term of this patent is extended or adjusted under 35 U.S.C. 154(b) by 0 days.

(21) Appl. No.: 16/069,196

(22) PCT Filed: Jan. 9, 2017

(86) PCT No.: PCT/DE2017/100010

§ 371 (c)(1),
(2) Date: Jul. 11, 2018

(87) PCT Pub. No.: WO2017/121427

PCT Pub. Date: Jul. 20, 2017

(65) Prior Publication Data

US 2019/0017432 A1 Jan. 17, 2019

(30) Foreign Application Priority Data

Jan. 12, 2016 (DE) ..... 10 2016 100 439

(51) Int. Cl.
*F02B 33/06* (2006.01)
*F01B 3/04* (2006.01)
(Continued)

(52) U.S. Cl.
CPC ..... *F02B 33/06* (2013.01); *F01B 3/04* (2013.01); *F02B 33/30* (2013.01); *F02B 75/26* (2013.01); *F02B 75/28* (2013.01); *F02B 75/282* (2013.01)

(58) Field of Classification Search
CPC ..... F02B 33/06; F02B 33/30; F02B 75/26; F02B 75/28; F02B 75/282; F01B 3/01
See application file for complete search history.

(56) References Cited

U.S. PATENT DOCUMENTS 972,504 A 10/1910 Brown
3,577,729 A 5/1971 Warren
(Continued)

FOREIGN PATENT DOCUMENTS

DE 199 09 689 A1 9/2000
DE 602 25 683 T2 4/2009
(Continued)

OTHER PUBLICATIONS

German Search Report dated Oct. 31, 2016 in German Application No. 10 2016 100 439.1 with English translation of relevant parts.
(Continued)

*Primary Examiner* — Kevin A Lathers
(74) *Attorney, Agent, or Firm* — Collard & Roe, P.C.

(57) ABSTRACT

In an axial piston motor in which fuel and compressed combustion medium are continuously burned in a combustion chamber so as to be turned into the working fluid and successively be delivered to working cylinders, at least one of the compressor discharge valves is closed in a positively controlled manner and is opened by a compressor pressure building up in the respective compressor cylinder.

20 Claims, 4 Drawing Sheets

Figure 1:
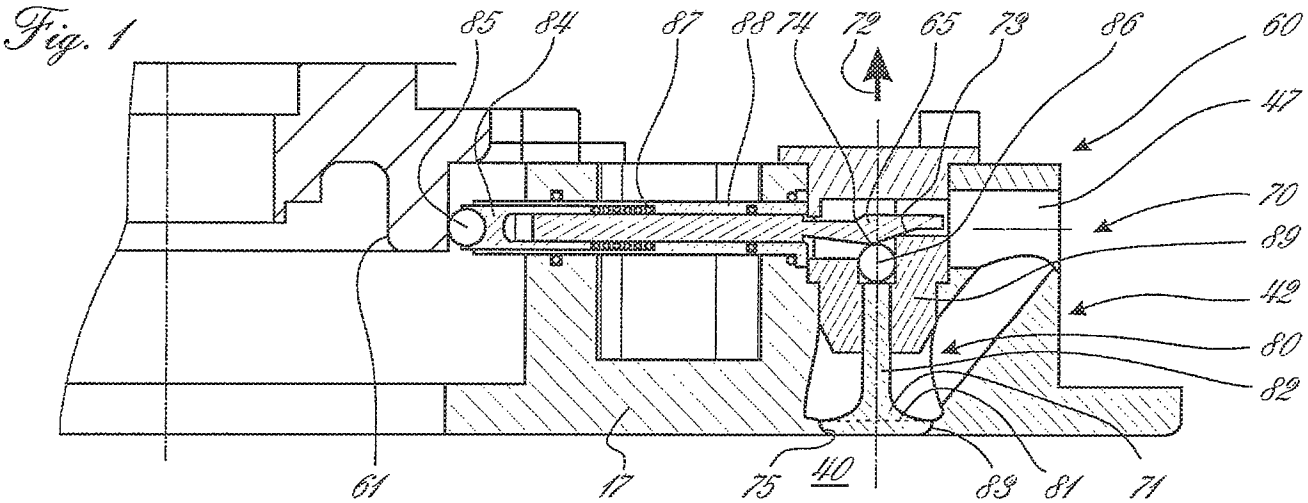

(51) Int. Cl.

| | |
|---|---|
| ***F02B 75/26*** | (2006.01) |
| ***F02B 75/28*** | (2006.01) |
| ***F02B 33/30*** | (2006.01) |

(56) References Cited

U.S. PATENT DOCUMENTS

| | | | | |
|---|---|---|---|---|
| 4,133,172 | A | 1/1979 | Cataldo | |
| 6,412,273 | B1 | 7/2002 | Rohs | |
| 7,201,122 | B2 | 4/2007 | Schmidt | |
| 8,926,279 | B2 | 1/2015 | Boston et al. | |
| 9,194,402 | B2 | 11/2015 | Rohs et al. | |
| 9,879,635 | B2 | 1/2018 | Rohs | |
| 2008/0202454 | A1 | 8/2008 | Pirault | |
| 2012/0118249 | A1* | 5/2012 | Rohs | F01B 3/00 123/56.1 |

FOREIGN PATENT DOCUMENTS

| | | | |
|---|---|---|---|
| DE | 10 2011 018846 | A1 | 7/2012 |
| EP | 1 035 310 | A2 | 9/2000 |
| WO | 01/16470 | A1 | 3/2001 |
| WO | 03/093662 | A1 | 11/2003 |
| WO | 2009/062473 | A2 | 5/2009 |
| WO | 2011/000943 | A1 | 1/2011 |
| WO | 2011/009453 | | 1/2011 |

OTHER PUBLICATIONS

International Search Report of PCT/DE2017/100010, dated Mar. 31, 2017.

* cited by examiner

METHOD FOR OPERATING AN AXIAL PISTON MOTOR, AND AXIAL PISTON MOTOR

CROSS REFERENCE TO RELATED APPLICATIONS

This application is the National Stage of PCT/DE2017/100010 filed on Jan. 9, 2017, which claims priority under 35 U.S.C. § 119 of German Application No. 2016 100 439.1 filed Jan. 12, 2016, the disclosures of which are incorporated by reference. The international application under PCT article 21(2) was not published in English.

The invention relates to a method for operation of an axial piston motor, in which method fuel and compressed combustion medium are continuously combusted in a combustion chamber to produce working medium, and delivered to successive working cylinders, in which working pistons move back and forth, which pistons in turn drive a power take-off and compressor pistons, which move back and forth in compressor cylinders, in which the combustion medium is compressed, wherein the combustion medium is drawn in by way of compressor inlet valves, and the compressed combustion medium is delivered to the combustion chamber by the compressor cylinders, by way of compressor outlet valves. Likewise, the invention relates to an axial piston motor having a combustion chamber that combusts continuously compressed combustion medium and fuel to produce working medium, having working cylinders that are connected with the combustion chamber by means of shot connections that can open and close cyclically, and in which working pistons move back and forth, having compressor cylinders in which compressor pistons move back and forth, which pistons are driven by the working pistons, and having at least one combustion medium feed line that leads from compressor outlet valves of the compressor cylinders to the combustion chamber, wherein at least one of the compressor outlet valves has a closure part that opens away from the compressor cylinder and interacts with a valve drive.

Such operating methods and axial piston motors are known from EP 1 035 310 A2 or WO 2011/009453 A2, for example. In this regard, EP 1 035 310 A2 discloses a ceramic ball that is pressed against its valve seat by the pressure that prevails in a pressure chamber or in a combustion medium feed line, and serves as a closure part of a compressor outlet valve. In this manner, the outlet valve remains closed as long as the pressure in the compressor piston lies below the pressure in the pressure chamber or below the pressure of the corresponding combustion medium feed line. If the pressure in the compressor cylinder rises above the pressure in the combustion medium feed line or the pressure chamber, the closure part of the compressor outlet valve, formed by the ceramic ball, opens and impacts a setting screw. As a result, the path into the pressure chamber is opened. WO 2011/009453 A2 also discloses such a passive control of the compressor outlet valve, using a valve cover configured as a hemisphere, which cover interacts with a valve cover pressure spring, so that ultimately, this compressor outlet valve is also controlled by way of the pressure difference between compressor cylinder and combustion medium feed line, wherein the spring force of the valve cover press-down spring ultimately acts only parallel to this pressure difference.

DE 602 25 683 T2 discloses a desmodromic valve control, in which a valve is opened and closed compulsorily.

It is the task of the present invention to make available a method for operation of an axial piston motor, as well as an axial piston motor, in which method and motor compression takes place as effectively as possible.

The task of the invention is accomplished by means of a method for operation of an axial piston motor and by an axial piston motor having the characteristics of the independent claims. Further advantageous embodiments, possibly also independent of these claims, can be found in the dependent claims and in the following description.

Thus, the most effective compression possible can take place, in the case of a method of the stated type, for operation of an axial piston motor, if this method is characterized in that at least one of the compressor outlet valves is closed with positive control, and opened by way of a compressor pressure that builds up in the respective compressor cylinder. In this manner, the combustion medium is delivered to the combustion chamber from the compressor cylinder, as long as sufficient compressor pressure can be found in the compressor cylinder, while it can be ensured by means of the positive-control closing process that no combustion medium flows back into the compressor cylinder, something that would lead to losses, accordingly.

It is understood that such method management is suitable also for multi-stage compression, in which the combustion medium that leaves the compressor is not delivered to the combustion chamber directly, but rather delivered to the combustion chamber indirectly by way of a further compression stage, such as a further compressor cylinder, for example.

In the method explained above, compression and work are separated, so that compression can take place at the lowest possible temperatures.

Preferably, the closing process of the at least one compressor outlet valve is initiated before the related compressor piston reaches its top dead center. It is true that at this point in time, compressed combustion medium is still flowing out of the compressor cylinder to the combustion chamber. However, this takes place at a relatively slight volume mass stream in the vicinity of the top dead center, so that the smaller valve throughput, resulting from the closing compressor outlet valve, is non-critical and hinders the flow only insignificantly.

Preferably, the closing process of the at least one of the compressor outlet valves is initiated no later than at 5°, preferably no later than 7° before the related compressor piston reaches its top dead center.

In this regard, it should be taken into consideration, in particular, that to close the compressor outlet valve, the closure part of the compressor outlet valve must be accelerated and must traverse a certain path distance until the compressor outlet valve is then ultimately closed. In that the closing process is initiated in timely manner, it can be ensured that the corresponding compressor outlet valve is also closed in timely manner, in particular also taking tolerances into consideration.

In this regard, the process of closing, which is compulsory or under positive control, after the closing process has been initiated, can ultimately take place, under some circumstances, by means of the moving mass of the one of the compressor outlet valves, and this particularly allows adherence to possible tolerances, particularly since the compressor outlet valve is kept closed by the pressure difference as soon as the related compressor piston has reached its top dead center. In this regard, it is not absolutely necessary that the corresponding compressor outlet valve is actively pressed down or stands in contact with a press-down arrangement up to the point when it is tightly sealed. In this regard, it is advantageous if at least one of the compressor outlet valves is freely closed by means of its own weight, more or less ballistically, after the closing process has been initiated.

Accordingly, it is advantageous if the at least one of the compressor outlet valves is closed when the related compressor piston reaches its upper dead center. As a result, possible return flow of combustion medium out of the combustion medium feed line into the respective compressor cylinder can be effectively prevented; as has already been indicated above, this can also be interrupted by a second compressor stage. In this manner, loss of compressed combustion medium can be reduced to a minimum or entirely prevented, since the compressor piston has a suction effect directly after the upper dead center is reached.

Because of the fact that the at least one of the compressor outlet valves is opened by way of the compressor pressure that builds up by way of the respective compressor cylinder, combustion medium can be conveyed to the combustion chamber immediately once sufficient pressure is present in the compressor cylinder.

In order to be able to guarantee corresponding, pressure-controlled opening of the corresponding compressor outlet valve, in reliable manner, it is advantageous if the at least one of the compressor outlet valves is released before the compression process in the respective compressor cylinder. This can already take place, for example, during priming. In particular, it can already take place no later than 12°, preferably no later than 10° after the related compressor piston has reached its upper dead center, since ultimately, the pressure difference between combustion medium feed line and compressor cylinder then already ensures that the corresponding compressor outlet valve remains tightly closed.

In particular, the at least one of the compressor outlet valves can be mechanically driven, and this allows a particularly precise form of drive, which is easy to implement in terms of construction.

It is preferable if the at least one of the compressor outlet valves is driven synchronously to the power take-off of the axial piston motor, wherein it is understood that the phases between the power take-off of the axial piston motor and the drive of the compressor outlet valve can be adapted as a function of the respective operating state, if necessary.

In the case of an axial piston motor of the stated type, the most effective compression possible can take place if this motor is characterized in that the closure part that interacts with a valve drive opens counter to a restriction arrangement, and if the valve drive can be released in the opening direction. This allows targeted closing of the closure part when this is advantageous, on the one hand, and opening of the closure part when sufficient pressure prevails in the compression cylinder, on the other hand.

Cumulatively or alternatively, the most effective compression possible takes place, in the case of an axial piston motor of the stated type, if this motor is characterized in that the closure part that interacts with the valve drive opens counter to the restriction arrangement, and the valve drive acts on the closure part only in the opening direction. This, too, allows compulsory closing of the closure part when this appears advantageous, on the one hand, while the closure part can open if sufficient pressure of combustion medium prevails in the compressor cylinder.

In the case of the axial piston motor of the stated type, as well, compression and work are separated, so that compression can take place at the lowest possible temperatures.

Preferably, the valve drive is configured to be mechanical, and this allows simple and precise control of the closure part.

In a concrete implementation, the valve drive can have a press-down arrangement, which acts on the closure part, thereby making it possible to make a valve drive that acts on the closure part only in the opening direction available in particularly simple manner, in terms of construction. In a concrete implementation, the valve drive can be released in the opening direction in that the press-down arrangement is removed from the closure part.

Thus, the press-down arrangement and the restriction arrangement can be situated on a common control module, so that the press-down arrangement or the restriction arrangement is displaced into a corresponding position by means of displacement of the control module, and the corresponding compressor outlet valve can be controlled in this manner.

Preferably, the press-down arrangement and the restriction arrangement are configured in one piece, relative to one another, on the control module, and this brings about a particularly simple configuration, in terms of construction.

In particular, the control module can be displaced between a stress position and a relief position, wherein in the stress position, preferably the press-down arrangement, and in the relief position, preferably the restriction arrangement are each positioned in such a manner that they can interact with the closure part. As a result, it can be guaranteed that in the stress position, the press-down arrangement acts on the closure part to press it down accordingly, while in the relief position, only the restriction arrangement delimits the valve path in the opening direction. Corresponding displacement can take place, for example, in that the control module is subjected to a corresponding pushing movement. Likewise, a tilting movement or rotational movement, for example, also of a tilting lever or the like, for example, can be provided, by means of which the control module changes between the stress position and the relief position, and offers the press-down arrangement or the restriction arrangement to the closure part for interaction, in each instance.

If necessary, the press-down arrangement and the restriction arrangement can also be configured to be identical; this can be implemented, in particular, in the case of press-down punches, armatures or tilting levers, for example.

Preferably, the press-down arrangement, the restriction arrangement and/or the control module are mounted resiliently. As a result, the forces that act on the closure part can be minimized, so that the useful lifetime of the part is increased; this is particularly advantageous if the closure part is configured in a lightweight design, for example constructed of very light materials or hollow on the inside. With regard to the press-down arrangement, in particular, reliable closing of the valve can also be guaranteed as a result, independent of unavoidable production tolerances. Alternatively or cumulatively to this, the closure part can also have a resilient mounting, which is effective with regard to the press-down arrangement, the restriction arrangement or the control module, in order to guarantee corresponding relief in this manner. Also, if necessary, resilient mounting can serve for tolerance equalization, if the press-down arrangement pressed on the valve even when it is closed and lies against it.

Cumulatively or alternatively to a resilient mounting, the press-down arrangement can be at a distance from the closure part when the compressor outlet valve is closed, in order to allow tolerance equalization in this manner. This is particularly possible if it is ensured in some other manner that the compressor outlet valve is closed in operationally reliable manner; this can be guaranteed by means of the inherent mass of the compressor outlet valve and/or the pressure difference, by way of the compressor outlet valve, or also with other measures, for example by means of magnetic forces, for example. The resilient mounting mentioned above can then still be utilized for purposes of material stress relief.

The combustion chamber can be effective in two stages, as is already sufficiently known from the state of the art, and can have a pre-burner, which essentially serves to prepare the major portion of the fuel thermally, before it is brought into contact with the combustion medium, which generally represents air, in a main combustion chamber. It is understood that combustion chambers having a different structure can also be easily used in corresponding axial piston motors.

As was already indicated above, the combustion medium feed line can also have a relatively complex structure. Thus, it is conceivable that the combustion medium feed line has multiple lines, configured in parallel, which then reach separately from individual compressor cylinders to the combustion chamber, for example. Likewise, the combustion medium feed line can also comprise further compressor stages, as already indicated above, and consequently first open into a further compressor cylinder, and then lead from the compressor outlet valve or compressor outlet valves of the latter to the combustion chamber. Also, pressure chambers can be provided after the compressor cylinders, as components of the combustion medium feed line, in which chambers the combustion medium made available by the compressor cylinders is first collected and then delivered to the combustion chamber in one or more feed lines. Also, the combustion medium feed line can comprise one or more heat exchangers, with which the combustion medium is tempered before entry into the combustion chamber, wherein here, the exhaust gas from the working cylinders, i.e. its thermal energy is preferably utilized, as is already known from the state of the art.

Preferably, the one of the compressor outlet valves is a plate valve, the valve cover of which is the closure part, and on the valve shaft of which the valve drive acts. In this manner, a corresponding axial piston motor can be implemented in structurally simple and precise manner. On the other hand, it is understood that possibly a ball of a ball valve or also a corresponding hemisphere can be used as the closure part, as long as a corresponding valve drive is provided here, too.

The valve drive can, in particular, have a cam disk or a cam shaft, which is synchronized with a power take-off of the axial piston motor. As a result, corresponding synchronization can be implemented in structurally simple and precise manner, wherein it is then particularly possible to drive the closure part mechanically or by way of a mechanically configured valve drive. On the other hand, it is understood that an electrical, hydraulic or pneumatic signal can also be generated by way of the cam disk or cam shaft, which signal can then be utilized accordingly for synchronization of the valve drive.

Preferably, the valve drive also drives further compressor outlet valves or compressor inlet valves, and this results in a correspondingly effective method of construction, i.e. very little construction effort.

The movement directions of the pistons in the compressor cylinders and working cylinders are oriented parallel to the power take-off shaft or to the power take-off as an axial piston motor. Preferably, the combustion chamber is disposed centrally relative to the working pistons, so that an identical or very similar path distance must be traversed for each of the working cylinders, and the axial piston motor works very uniformly.

It is understood that the characteristics of the solutions described above and in the claims can also be combined, if applicable, in order to be able to implement the advantages cumulatively, accordingly.

Figure 2:
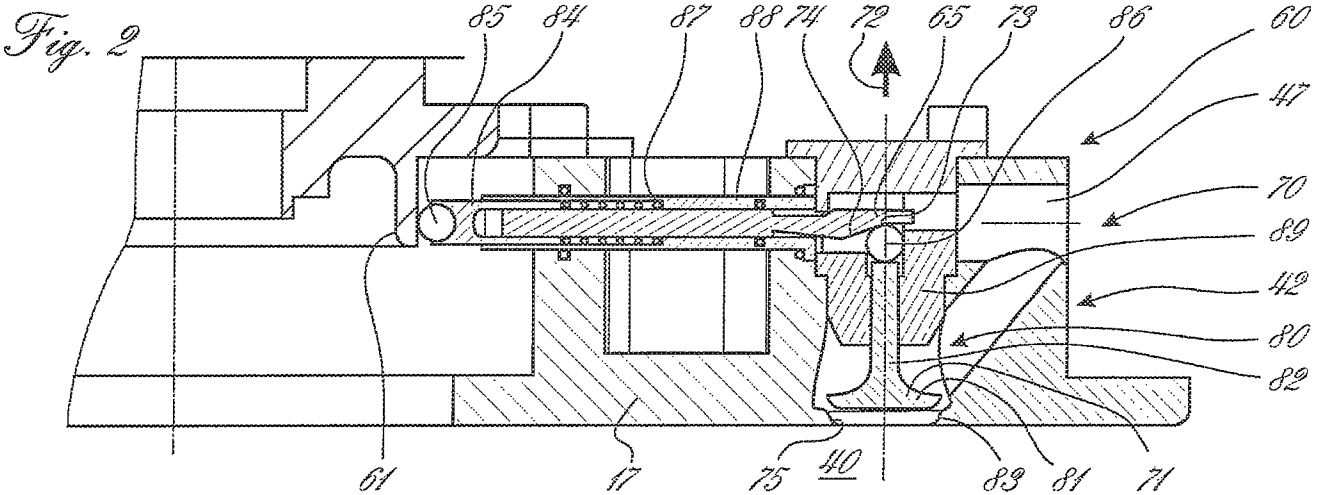
Figure 3:
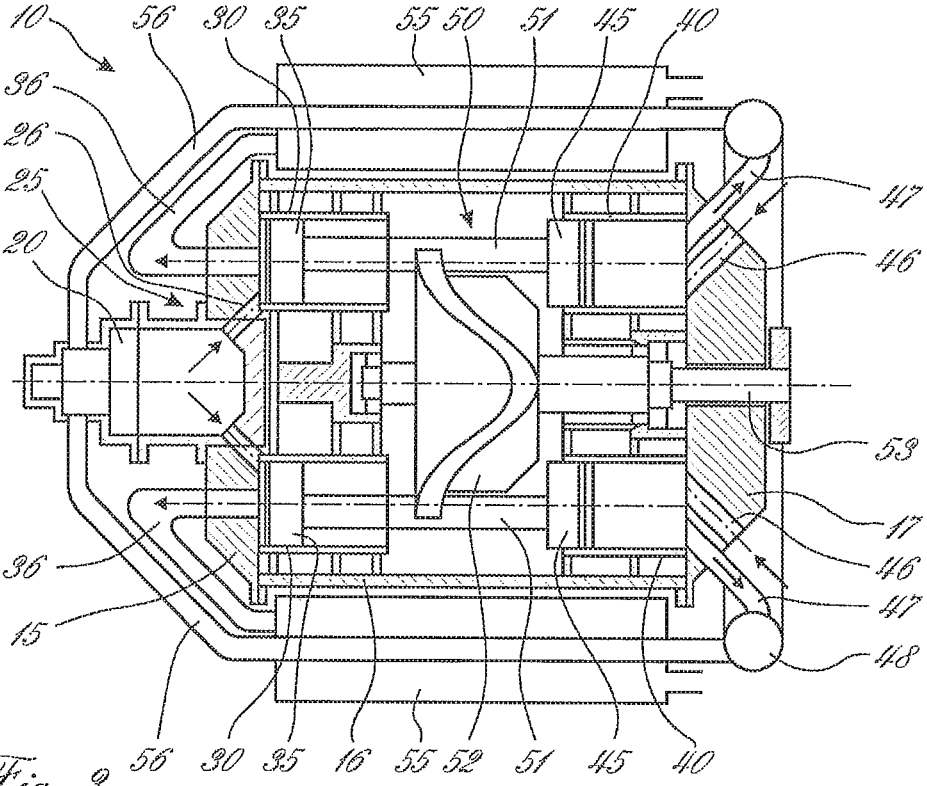
Figure 4:
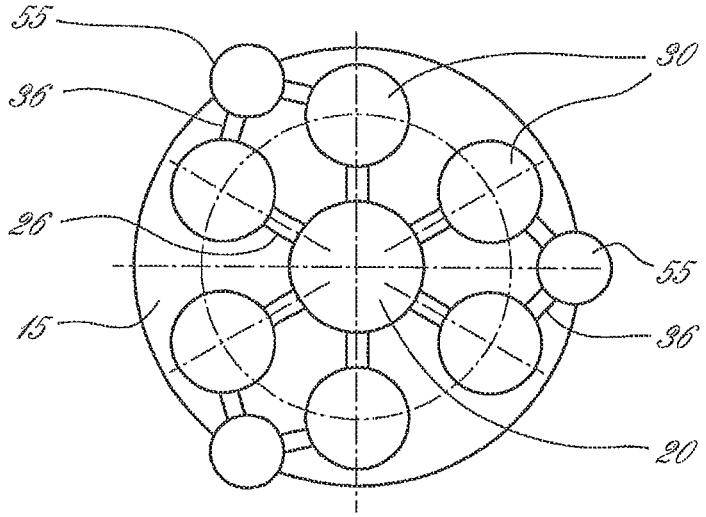
Figure 6:
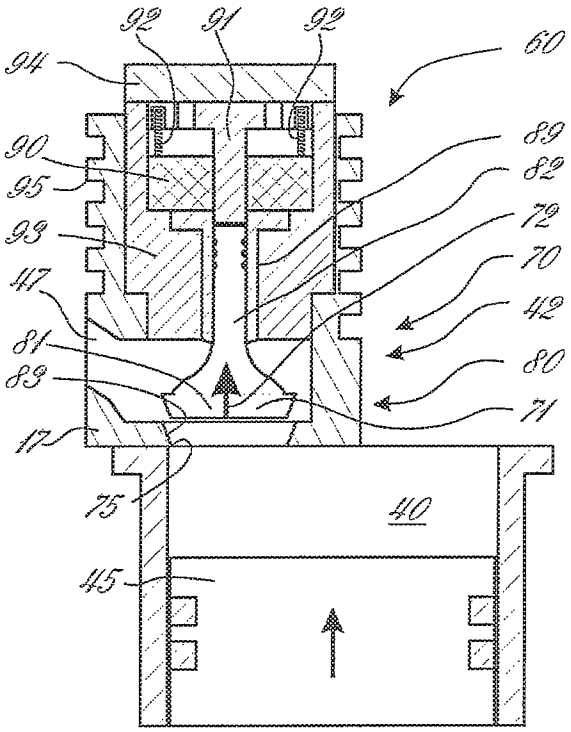
Figure 5:
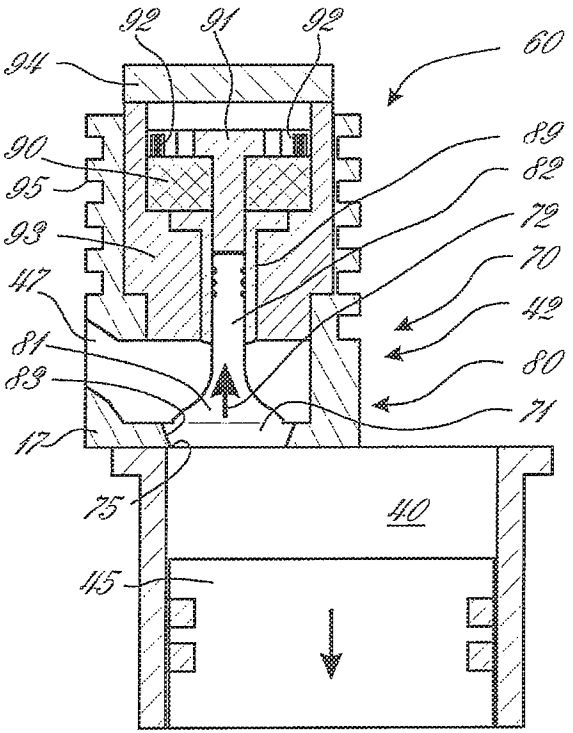
Figure 7:
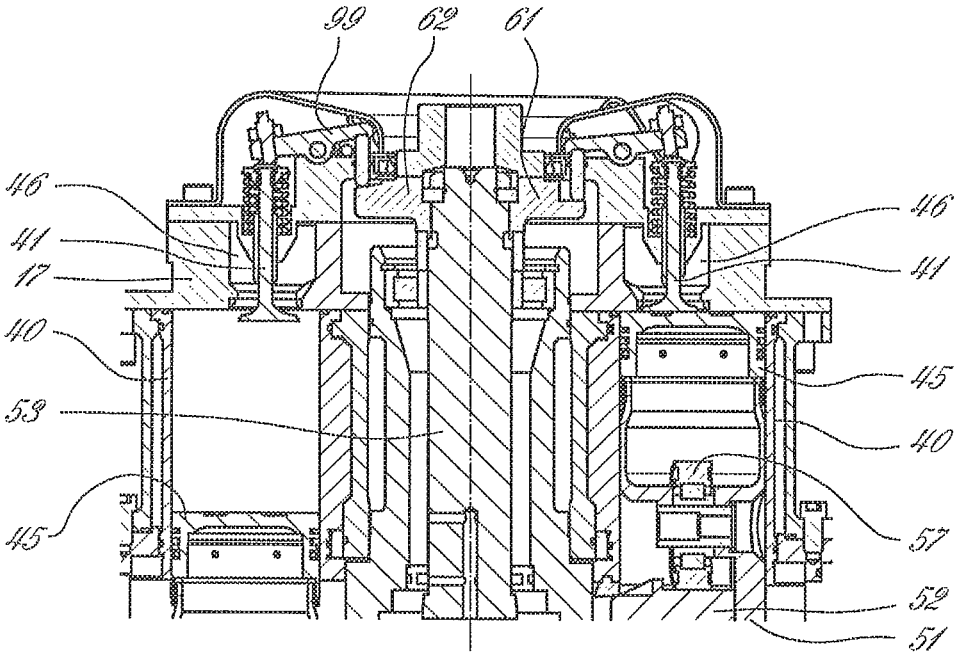
Figure 8:
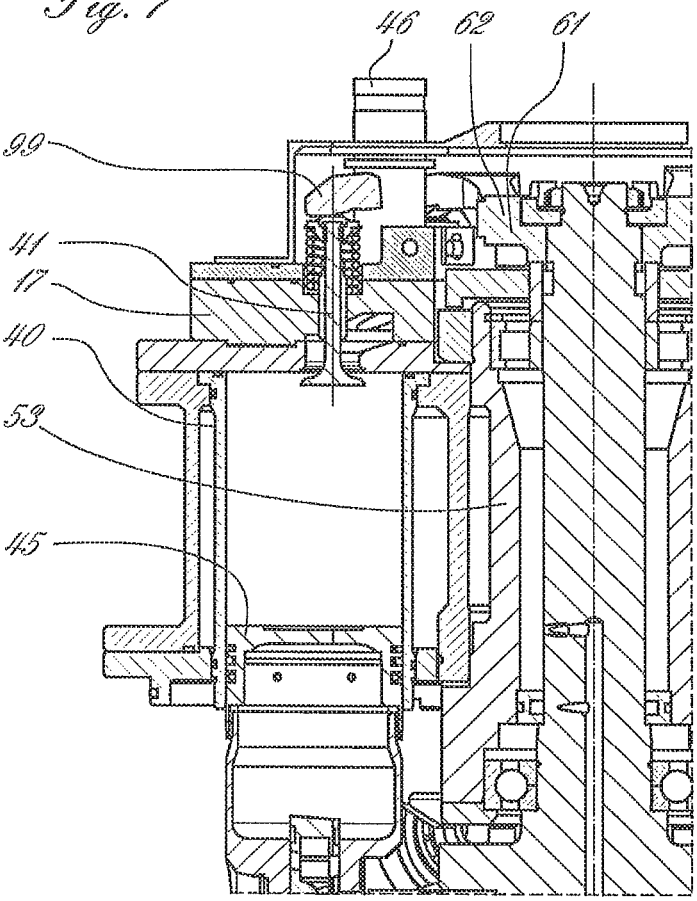

Further advantages, goals, and properties of the present invention will be explained using the following description of exemplary embodiments, which are also shown, in particular, in the attached drawing. The drawing shows:

FIG. 1 a schematic section through a compressor cylinder head of an axial piston motor, with the compressor outlet valve closed;

FIG. 2 the configuration according to FIG. 1, with the compressor outlet valve open;

FIG. 3 a schematic cross-section through an axial piston motor, in which the compressor cylinder head according to FIGS. 1 and 2 can be used;

FIG. 4 a schematic section through the combustion chamber and the working cylinders of the axial piston motor according to FIG. 3;

FIG. 5 a schematic detail representation of a further compressor cylinder head, which can be used in the configuration according to FIGS. 3 and 4, with the compressor outlet valve closed;

FIG. 6 the configuration according to FIG. 5, with the compressor outlet valve open;

FIG. 7 a further compressor cylinder head, which can be used in the axial piston motor according to FIGS. 3 and 4, in schematic section; and FIG. 8 a further compressor cylinder head, which can be used in the axial piston motor according to FIGS. 3 and 4, in schematic section.

The compressor cylinder head 17 shown in FIGS. 1 and 2 can be used in the axial piston motor 10 shown in FIGS. 3 and 4, and has at least one combustion medium inlet 46 and one combustion medium outlet 47 to compressor cylinders 40.

The combustion medium, which is compressed in the compressor cylinders 40 by means of compressor pistons 45 that move back and forth is collected in a manifold 48, into which the combustion medium outlets 47 of the individual compressor cylinders 40 open.

A multi-part combustion medium feed line 56, which is configured in three parts in this exemplary embodiment, in accordance with the number of heat exchangers 55, reaches from the manifold 48 through the heat exchangers 55 to a combustion chamber 20, wherein the manifold 48 should also be counted as part of the combustion medium feed line 56. In deviating embodiments, the combustion medium feed lie 56 can be structured in simpler or more complex manner, and can also lead to further compressor stages, for example, or can be interrupted by further compressor stages, wherein these can also have corresponding valves and combustion medium inlets and/or outlets, if applicable.

Proceeding from the combustion chamber 20, shot connections 25 extend to working cylinders 30, in each instance, which are represented by shot channels 26 between the combustion chamber 20 and the respective working cylinders 30, which can be periodically opened and closed. Depending on the concrete implementation of the exemplary embodiment, this can be implemented, for example, by means of Burt-McCollum sleeve valves that surround the working cylinders, by means of control pistons or by means of rotary valves disposed coaxially relative to the combustion chamber 20 or the like.

Working pistons 35 move back and forth in the working cylinders 30; these pistons are connected with a compressor piston 45, in each instance, by way of a piston rod 51, wherein the piston rods 51 interact with a cam disk 52 of a power take-off 50, which disk is disposed on a power take-off shaft 53. The piston rod 51 interacts with the cam disk 52 of the power take-off 50 by way of a large end bearing 57 (see FIG. 7).

The compressor cylinders 40, compressor pistons 45, working cylinders 30, working pistons 35, and piston rods 51 are disposed coaxially around the combustion chamber 20 and the power take-off shaft 53, in star shape.

The axial piston motor 10 comprises a housing 16, which has a working cylinder head 15 having the shot channels 26 as well as lines for exhaust gas 36 and exhaust gas valves, which are not shown in any detail but are sufficiently known, on one side.

Likewise, the housing 16 carries the compressor cylinder head 17.

The exhaust gas 36 is conducted into the heat exchangers 55 and its thermal energy is conducted, in the heat exchangers 55, to the compressed combustion medium that is situated in the combustion medium feed line 56, before this medium is used for combustion of fuel in the combustion chamber 20, which works continuously. It is true that in the schematic representation of FIGS. 3 and 4, only a single-stage combustion chamber is indicated. It is understood that here, multi-stage combustion, in particular with a pre-burner for preparation of the fuel, can also be provided.

The combustion medium outlet 47 provided in the compressor cylinder head 17 can be opened and closed by means of a compressor outlet valve 42.

The compressor outlet valve 42 configured as a plate valve 80 comprises a closure part 71 as a valve 70, which part is formed by a valve cover 81 of the plate valve 80, as well as a counter-part 75, which is formed by the compressor cylinder head 17 itself and represents the valve seat 83 of the plate valve 80. The plate valve 80 furthermore comprises a valve shaft 82, which is guided by a valve guide 89, so that the valve 70 can be reliably opened and closed. In this regard, the valve guide 89 sits in the compressor cylinder head 17.

A control module 65, which is mounted in the compressor cylinder head 17 so as to be radially displaceable with reference to the power take-off shaft 53, by way of a sleeve-like control module guide 88, and is pressed against a cam disk 61 by way of a press-down spring 87, serves as a valve drive 60, wherein the control module 65 carries a cam follower ball 85 that runs on the cam disk 61 in order to reduce friction losses. The press-down spring 87 supports itself on the control module guide 88, on the one side, and on a sleeve 84, on the other side, in which the control module 65 is attached, so that the control module 65 is controlled synchronously to the rotation of the power take-off shaft 53 by way of the cam disk 61, since the cam disk 61 is set onto the power take-off shaft 53.

A control ball 86 is provided between the valve shaft 82 and the control module 65, so as to reduce friction losses.

The control module 65 has a restriction arrangement 73 and a press-down arrangement 74, which are provided at different positions of the control module 65, viewed radially with reference to the power take-off shaft 53. Then—depending on the cam track of the cam disk 61—the restriction arrangement 73 or the press-down arrangement 74 can be brought into an interaction position with the control ball 86 by means of the cam disk 61.

Viewed in the axial direction, the press-down arrangement 74 is provided so close to the valve seat 83 that the valve cover 81 is pressed against the valve seat 83, and the compressor outlet valve 42 is closed, when the press-down arrangement 74 is disposed in its interaction position with reference to the control ball 86, as shown in FIG. 1.

If, in contrast, the restriction arrangement 73 is disposed in its interaction position with reference to the control ball 86, then the valve cover 81 can open from its valve seat 83 in an opening direction 72, if the gas pressure in the compressor cylinder 40 exceeds the gas pressure in the combustion medium outlet 47, as shown as a example in FIG. 2.

To this extent, the control module 65, i.e. the valve drive 60 releases the valve 70 in the opening direction 72 if the restriction arrangement 73 is disposed in its interaction position relative to the control ball 86. The valve can then open on its own, controlled by the gas pressure. If, on the other hand, the press-down arrangement 74 of the control module 65 is brought into the interaction position with the control ball 86 by the valve drive 60, then the valve 70 is compulsorily closed.

The restriction arrangement 73 as well as the press-down arrangement 74 are provided on a resilient arm of the control module 65, so that the control module 65 resiliently interacts with the closure part 71 of the valve 70. This relieves stress on the material of the valve 70, on the one hand, and on the other hand serves to guarantee a reliable seat of the closure part 71 on its counter-part 75, in particular also taking unavoidable production tolerances into consideration.

In this exemplary embodiment, the geometries between the press-down arrangement 74 and the valve shaft 82, the control ball 86 or the valve seat 83 are coordinated with one another in such a manner that the press-down arrangement 74 remains at a distance from the control ball 86 when it is brought into its interaction position relative to the control ball 86, when the compressor outlet valve 42 is closed, so as to take possible production tolerances into consideration in this manner. The compressor outlet valve 42 in itself closes ballistically, in other words due to its own movement and mass, if it was accelerated in the closing direction accordingly by the control module 65. Furthermore, the pressure difference above the compressor outlet valve 42 also acts to close the valve as soon as the top dead center of the corresponding compressor piston 45 has been reached. It is understood that in an alternative embodiment, the press-down arrangement 74 can possibly lie against the control ball 86 in its interaction position, even when the compressor outlet valve 42 is closed, if the resilient mounting is sufficiently coordinated with the tolerances.

In the case of the exemplary embodiment shown in FIGS. 5 and 6, a magnet 90 having an armature 91 serves as the valve drive 60; these also interact with a valve 70 structured as a plate valve 80.

The valve guide 89 is recessed into an aluminum support 93, which carries a stop 94 on the side of the armature 91 that faces away from the magnet 90, against which stop springs 92 press the armature 91. When current is applied to the magnet 90, the armature 91 is pulled against the magnet 90 counter to the spring force of the springs 92 and counter to the opening direction 72. When the magnet 90 is turned off, the springs 92 are able to press the armature 91 against the stop 94 again, in the opening direction 72.

In the region of the aluminum support 93, the region of the compressor cylinder head 17 that surrounds the aluminum support 93 has cooling ribs 95.

This configuration also makes it possible that the closure part 71 of the valve 70 can open freely in the opening direction and in limited manner only due to the pressure difference between compressor cylinder 40 and combustion medium outlet 47, whereas it can be closed by way of the magnet 90. In this regard, the shaft of the armature 91 that comes into contact with the closure part 71 of the valve 70 serves both as a restriction arrangement 73 and as a press-down arrangement 74, wherein the compressor outlet valve 42, i.e. the valve 70 can be compulsorily closed counter to the opening direction 72 of the valve 70, by means of attraction of the armature 91.

In this exemplary embodiment, the valve shaft 81 or the valve seat 83 and the shaft of the armature 91 are coordinated with one another in terms of their geometries, in such a manner that the press-down arrangement 74 lies against the valve shaft 81 even when the compressor outlet valve 42 is closed. Here, a small gap can remain between armature 91 and magnet 90 for tolerance equalization. Alternatively, ballistic closing of the compressor outlet valve 42 can also be provided here, in that the valve shaft 81 or the shaft of the armature 91 are configured to be correspondingly shorter, so that the press-down arrangement 74 does not lie against the valve shaft 81 when the compressor outlet valve 42 is closed.

The configurations shown in FIGS. 7 and 8 show possible embodiments of compressor inlet valves 41, which are also controlled by way of the cam disk 61, which, however, acts as a cam shaft 62 there. In this regard, the respective compressor inlet valve 41 is controlled by way of an actuation lever 99.

REFERENCE SYMBOL LIST

10 axial piston motor
15 working cylinder head
16 housing
17 compressor cylinder head
20 combustion chamber
25 shot connection (numbered as an example)
26 shot channel (numbered as an example)
30 working cylinder (numbered as an example)
35 working piston
36 exhaust gas
40 compressor cylinder
41 compressor inlet valve
42 compressor outlet valve
45 compressor piston
46 combustion medium inlet
47 combustion medium outlet
48 manifold
50 power take-off
51 piston rod
52 cam disk
53 power take-off shaft
55 heat exchanger
56 combustion medium feed line
57 large end bearing
60 valve drive
61 cam disk
62 cam shaft
65 control module
70 valve
71 closure part
72 opening direction
73 restriction arrangement
74 press-down arrangement
75 counter-part
80 plate valve
81 valve cover
82 valve shaft
83 valve seat
84 sleeve
85 cam follower ball
86 control ball
87 press-down spring
88 control module guide
89 valve guide
90 magnet
91 armature
92 spring
93 aluminum support
94 stop
95 cooling ribs
99 actuation lever

The invention claimed is:

1. A method for operation of an axial piston motor comprising:

continuously combusting fuel and compressed combustion medium in a combustion chamber to produce working medium;

delivering the working medium to successive working cylinders;

drawing the combustion medium into compressor cylinders by way of compressor inlet valves;

moving working pistons back and forth in the working cylinders to drive a power take-off and compressor pistons back and forth in the compressor cylinders to produce the compressed combustion medium;

delivering the compressed combustion medium to the combustion chamber by the compressor cylinders by way of compressor outlet valves;

closing at least one of the compressor outlet valves with positive control via a valve drive producing a closing force affecting a closure part of the at least one of the compressor outlet valves; and opening the at least one of the compressor outlet valves by way of a removal of the closing force of the valve drive and by way of a compressor pressure that builds up in the respective compressor cylinder.

2. The operating method according to claim 1, wherein the closing process of the at least one of the compressor outlet valves is initiated before the related compressor piston reaches its top dead center.

3. The operating method according to claim 2, wherein the closing process of the at least one of the compressor outlet valves is initiated no later than 7° before the related compressor piston reaches its top dead center.

4. The operating method according to claim 2, wherein the closing process of the at least one of the compressor outlet valves is initiated no later than 5° before the related compressor piston reaches its top dead center.

5. The operating method according to claim 1, wherein the at least one of the compressor outlet valves is closed when the related compressor piston reaches its top dead center.

6. The operating method according to claim 1, wherein the at least one of the compressor outlet valves is freely closed by its own weight after the closing process has been initiated.

7. The operating method according to claim 1, wherein the positive control is released from the at least one of the compressor outlet valves before the compression process.

8. The operating method according to claim 1, wherein the at least one of the compressor outlet valves is mechanically driven.

9. The operating method according to claim 1, wherein the at least one of the compressor outlet valves is driven synchronously to a power take off of the axial piston motor.

10. An axial piston motor having a combustion chamber that combusts continuously compressed combustion medium and fuel to produce working medium, having working cylinders that are connected with the combustion chamber by connections that can open and close cyclically, having working pistons moving back and forth in the working cylinders, having compressor cylinders in which compressor pistons move back and forth, which compressor pistons are driven by the working pistons, having at least one combustion medium feed line that leads from compressor outlet valves of the compressor cylinders to the combustion chamber, and having a valve drive configured to exert a positive control acting on a closure part of at least one of the compressor outlet valves in an opening direction, the closure part opening away from the compressor cylinder, wherein the closure part interacts with the valve drive and opens counter to a restriction arrangement, and wherein the valve drive releases the closure part in the opening direction so that a compressor pressure that builds up in the compressor cylinder is able to open the at least one of the compressor outlet valves and/or exerts the positive control acting on the closure part only in the opening direction.

11. The axial piston motor according to claim 10, wherein the valve drive is configured mechanically.

12. The axial piston motor according to claim 10, wherein the valve drive has a press-down arrangement that acts on the closure part.

13. The axial piston motor according to claim 12, wherein the press-down arrangement and the restriction arrangement are configured in one piece with one another.

14. The axial piston motor according to claim 12, wherein the press-down arrangement is at a distance from the closure part when the compressor outlet valve is closed.

15. The axial piston motor according to claim 12, wherein the press-down arrangement and the restriction arrangement are situated on a control module.

16. The axial piston motor according to claim 15, wherein the control module can be displaced between a stress position and a relief position.

17. The axial piston motor according to claim 10, wherein the press-down arrangement, the restriction arrangement and/or the control module are mounted resiliently.

18. The axial piston motor according to claim 10, wherein the one of the compressor outlet valves is a plate valve, the valve cover of which is the closure part and on the valve shaft of which the valve drive acts.

19. The axial piston motor according to claim 10, wherein the valve drive has a cam disk or a cam shaft, which is synchronized with a power take-off of the axial piston motor.

20. The axial piston motor according to claim 10, wherein the valve drive also drives further compressor outlet valves and/or compressor inlet valves.

* * * * *